United States Patent [19]

Kelly

[11] 4,337,291

[45] * Jun. 29, 1982

[54] DECORATIVE LAMINATE SURFACE FOR BOWLING LANE SURFACE HAVING REDUCED GLOSS

[75] Inventor: Peter B. Kelly, Bloomfield Hills, Mich.

[73] Assignee: General Electric Company, Coshocton, N.Y.

[ * ] Notice: The portion of the term of this patent subsequent to Nov. 4, 1997, has been disclaimed.

[21] Appl. No.: 127,567

[22] Filed: Mar. 6, 1980

Related U.S. Application Data

[60] Continuation-in-part of Ser. No. 926,604, Jul. 21, 1978, Pat. No. 4,231,573, which is a division of Ser. No. 901,791, May 1, 1978, abandoned, which is a continuation of Ser. No. 506,069, Sep. 16, 1974, abandoned.

[51] Int. Cl.[3] ..... A63D 1/04; B32B 5/26; B32B 5/30; B32B 31/20

[52] U.S. Cl. ..... 428/204; 156/61; 156/307.4; 273/51; 428/207; 428/211; 428/409; 428/526; 428/528; 428/529; 428/530; 428/531; 428/535; 428/322.2

[58] Field of Search ..... 156/61, 309; 273/51; 428/204, 207, 211, 528, 530, 535, 409, 526, 531, 529

[56] References Cited

U.S. PATENT DOCUMENTS 2,857,302 10/1958 Burton et al. .
3,445,327 5/1969 Griffin .

*Primary Examiner*—James C. Cannon
*Attorney, Agent, or Firm*—Hedman, Casella, Gibson & Costigan

[57] ABSTRACT

A bowling lane having a decorative laminate surface in which the lane approach surface and the lane surface proper has a finish which provides a 60 degree gloss below about 30 in the machine direction as measured according to NEMA Standard 8-19-1964.

15 Claims, No Drawings

DECORATIVE LAMINATE SURFACE FOR BOWLING LANE SURFACE HAVING REDUCED GLOSS

RELATED APPLICATIONS

This application is a continuation-in-part of my U.S. patent application Ser. No. 926,604, filed July 21, 1978, now patent No. 4,231,573 which is a division of my U.S. Patent Application Ser. No. 901,791, filed May 1, 1978, now abandoned, which is a continuation of my patent Application Ser. No. 506,069, filed Sept. 16, 1974, now abandoned.

BACKGROUND OF THE INVENTION

1. Field of the Invention

This invention relates to new and improved surfaces for bowling lanes. More particularly, it relates to bowling lanes in which the approach surface and the lane surface proper is of a suitable decorative laminate having a low gloss surface finish.

2. Description of the Prior Art

Standard bowling lanes are often constructed of suitably finished hardwood blocks or planking. In such a lane bed, usually about 41 to 42 inches wide, the construction typically consists of from about 39 to 42 maple planks or boards about one inch thick laid edgewide or on edge in line with the longitudinal axis of the lane. The surface of the lane is made flat and coated with varnish or lacquer which is then treated, as with mineral oil, to reduce wear and adjust the coefficient of friction or slippage of the surface in order to produce uniform action and control the bowling ball. The surface finish consists typically of a nitrocellulose or polyurethane lacquer which can be treated with plasticizers and other additives to provide with the oil treatment the desired wear and slippage or friction characteristics.

While wooden lanes have been in use for many years, they are subject to a number of deficiencies which have defied correction despite much work expended on the problem. For example, present wooden lanes are severely damaged in the areas of ball release and at the pin deck. Such damage in the ball release area is intensified by lofting of the ball which, upon impact, dents the lacquered and oiled wooden surface and damages the lane to a lesser degree even with normal release of the ball. Surface damage in the pin deck area is primarily caused by contact of the struck pins with the surface. Under ordinary circumstances, standard bowling lanes are inspected and often refinished and resurfaced on an annual basis. Such refinishing is necessary in order to meet set bowling standards and in order to provide uniformity of all lanes so that comparable performance and scoring can be attained insofar as these factors are controlled by the physical condition of the bowling lane itself as opposed to skill of the bowler.

Materials other than wood have been suggested for use in bowling lanes. For example, U.S. Pat. No. 2,531,168 teaches a top surface layer for bowling alleys formed of laminated plastic compounds such as phenolic, vinyl, acrylic, cellulose acetate, etc. And U.S. Pat. No. 3,014,722 discloses bowling alley lanes formed of sections of laminated fibrous sheet material plies. Other materials have also been disclosed in U.S. Pat. No. 3,670,049 (a moisture curable polyurethane coating composition suitable for finishing bowling lanes); U.S. Pat. No. 3,670,060 (metal bowling alley lanes); U.S. Re. No. 25,496 (granite as a material for fabricating bowling alley lanes); U.S. Pat. No. 2,679,396 (hard rubber as a bowling alley lane material); and U.S. Pat. No. 2,193,468 (grass like carpet useful in covering a game alley). None of these wood substitutes have proven to be commercially acceptable and wood lanes predominantly remain the materials in common usage today.

U.S. Pat. No. 3,674,619 discloses the use of aluminum foil having a thickness of about 0.3 mil bonded to kraft paper to obtain a textured surface. U.S. Pat. No. 3,418,189 discloses the use of non-adherable aluminium foil as a decorative stencil in producing decorative laminates. And U.S. Pat. No. 3,445,327 discloses use of a thin layer of dead soft foil such as aluminum foil to provide a textured surface appearance on a decorative laminate.

Japanese application No. SHO-50-111020 laid open for inspection on May 18, 1976 as Publication No. SHO-51-56548, corresponds to U.S. patent application Ser. No. 506,069 filed Sept. 16, 1974, now abandoned, (the disclosure of which was carried forward in U.S. patent application No. 926,604, filed July 21, 1978 [hereinafter the '604 application]) and discloses a high pressure laminate surface suitable for bowling alley lanes. These bowling lane surfaces have been successfully tested in the United States and been welcomed as an advance in the art. See e.g. Bowling January, 1977 at page 6.

The '604 application discloses a bowling lane surface which is a wear and impact resistant decorative plastic laminate having a plurality of thermosetting resin impregnated decorative fibrous print sheet and an overlying melamine resin-containing protective layer, the decorative surfacing being in the form of panels which can be cemented, fixed or suitably adhered to the lane substrate which can be of wood as above or of hardboard, plywood, flakeboard, chipboard or the like, or even of concrete, cement-asbestos board, filled asphalt, stone or metal sheets as desired. The laminate surface is so constructed as to approximate the same reaction to ball delivery as wooden lanes. It has also been suggested that the lane surface be made of sheets of resinous material such as phenolformaldehyde and the like.

At the ball delivery end of the lane, there is normally a foul line which divides the lane or alley proper from the approach or runway area. In actual play, no player is permitted to cross without being penalized. Players typically take one or more steps up to the vicinity of the foul line and slide their feet on the approach area near the foul line while releasing the bowling ball on the lane or alley proper. Although the decorative plastic laminate surface described hereinabove is perfectly acceptable within the usual range of texture in terms of its slipperiness, it has a high gloss sheen.

For psychological reasons, players equate the high gloss sheen with a slippery approach even though the slide characteristics of the decorative plastic laminate surface were judged excellent by the American Bowling Congress. In particular, women bowlers and hard throwing, less skilled bowlers, tended to judge the approach or runway area on such plastic laminate surfaced bowling lanes too slippery.

SUMMARY OF THE INVENTION

1. Objects of the Invention

It will be seen from the above that there is a need for bowling lanes and surfaces, therefore, which are more resistant to physical abuse and wear, have uniformity of surface and which can maintain these qualities over a long period of time.

The bowling lane and surface described in the '604 application, assigned to the same assignee as this application, responds, in part, to this need. As previously indicated herein, the bowling lane and surface disclosed in the '604 application has made for a significant advance in the art. The present invention is considered to be an improvement on the invention of the '604 application and its main features and objectives are thus similar to those of the '604 application.

From the above, it will be seen that it would be most desirable in a bowling alley to have a low gloss sheen on the surface of the approach area and the lane proper. It is a primary object of the present invention to provide such a low gloss sheen on the surface of the lane and approach area when a decorative plastic laminate surface is employed as described hereinabove.

Those features of the invention which are believed to be novel are set forth with particularity in the claims appended hereto. The invention will, however, be better understood and further advantages and objects thereof appreciated from a consideration of the following description.

2. Brief Summary of the Invention

The bowling lane surfaces described in the '604 patent application have a NEMA Standard 8-19-64 falling ball impact resistance of over 60 inches as compared to 32 inches for a typical varnished or lacquered hardwood lane. When a 16-pound standard bowling ball was dropped on the bowling lane described in the '604 application from a height of 3 feet, there was no effect. Both with polyurethane varnish and the nitrocellulose lacquer treated wooden bowling lanes, a deep surface dent resulted from such treatment and the wood fibers of the surface were torn. As measured by the Taber abraser, the NEMA Standard 8-20-1962 abrasion resistance of the lanes described in the '604 application is from about 500 cycles to 2500 cycles depending on the particular surface, whereas the polyurethane varnish and nitrocellulose lacquer finished lanes have a Taber abrasion resistance of 40 cycles and 25 cycles respectively. The resistance of the surfaces described in the '604 application to a burning cigarette in accordance with NEMA Standard 8-19-64 is 300 seconds as opposed to 90 seconds to charring for the polyurethane varnish and 24 seconds to burning with the nitrocellulose lacquer. The slip or coefficient of friction of the surfaces, described in the '604 application is 0.18 as compared to 0.16 for typical nitrocellulose lacquer coated lanes, all measurements being taken with an oil-treated surface. The surfaces of the '604 application are furthermore resistant to staining by alcohol, detergent, shoe polish, and mustard whereas polyurethane varnished surface lanes are stained by mustard, and nitrocellulose lacquer surface lanes are stained by alcohol, shoe polish and mustard. The 60 degree gloss of the lanes described in the '604 application is also comparable to those of present hardwood lanes surfaced with nitrocellulose lacquer.

Briefly, according to the present invention, the lane approach surface and the lane surface proper is comprised of a suitable decorative laminate panel having a 60 degree gloss below about 30, preferably between about 10 and about 20 measured in the machine direction.

Gloss should not be confused with reflectance or apparent reflectance. By reflectance is meant the ratio of the total quantity of light which is reflected from a surface to the total quantity of incident light on the surface regardless of direction. By apparent reflectance is meant a specified condition of view or reflection. By gloss is meant the light which is specularly reflected, i.e., when the angle of incidence is equal to the angle of reflection. Gloss is determined by the smoothness of the surface; it describes the "mirror effect". Reflectance is determined by color and shading of the opaque laminate and is independent of surface finish. Gloss is determined by NEMA Standard 8-19-1964 Pub. No. LD 1-1.05. Using NEMA Standard 9-21-1966, a 60 degree gloss was determined for the decorative laminate panel in both the machine and the cross-machine direction. For purposes of finishes, the machine direction is the direction giving the higher gloss reading.

3. Detailed Description of the Preferred Embodiments

The bowling lane surfaces or laminates of the present invention are readily made. The core sheets are typically of Kraft paper which can be impregnated with any of the thermosetting resins conventionally used in the production of decorative laminates. The most common of these resins is a condensation product of phenol and an aldehyde and generally an alkaline catalyzed phenol formaldehyde condensation product. A specific phenolic resin used in this connection is a light colored, thermosetting, general purpose phenol formaldehyde resin of the above description sold by the Monsanto Company under the name of Resinox 470. As in typical decorative laminates, the core sheets of Kraft paper or creped Kraft paper or selected combinations of such papers are overlaid with a so-called print sheet which imparts the decorative effective as of wood grain or any other finish to the laminate. While the print sheet can be impregnated as is usual in ordinary decorative laminates, it has been found that a lesser amount than usual of the thermosetting resin impregnant is desirable in the print sheet to toughen the surface of the laminate and make it more impact and fracture resistant in order to resist grooving of the surface and denting. Any of a number of thermosetting resin can be used for impregnating the print sheet where this is indicated including, preferably, a condensation product of melamine and an aldehyde, such materials being characterized by excellent wearing, translucency and resistance to discoloring. A specific material found useful in this connection is a modified melamine formaldehyde reaction product sold by American Cyanamid Company under the name of Cymel 428. This resin is a white, free-flowing powder specifically designed for the treatment of paper to be used in decorative laminates. The resin is readily soluble in water or in alcohol-water solvents and gives a clear, colorless solution which is stable at 50 percent by weight solids content for at least two days ar room temperature. Typical properties of a 50 percent aqueous solution of this resin at 25° C. include a pH of 8.8 to 9.6, a Gardner viscosity of A to B, and a solids content at maximum dilution in water of 26 percent. However, other resins such as ureas, aminotriazines, light highly purified phenolic resins, polyester resins including unsaturated alkyd-vinyl monomer types, acrylics, ethoxyline resins and the like can also be used. Among the melamine resins which can be used are the several more fully described in U.S. Pat. No. 2,605,205. In preparing the plastic laminate, the core Kraft paper is impregnated in any desired manner with the thermosetting resin and dried, the resin content of the dried core paper sheet before consolidation ranging generally from about 25 to 29 percent by weight for ordinary Kraft paper and from about 34 to 37 percent by weight of resin for the normally used creped Kraft paper.

Where a paper overlay or protective layer is used, this is normally of a highly purified, transparent, alpha cellulose although it can also consist of other transparent or highly translucent cellulosic or synthetic resin fibers such as those of rayon or mixtures of such fibers such as those described in U.S. Pat. No. 2,816,851, among others. This material is impregnated with a melamine resin such as that above and usually dried to a resin content of from about 33 to 42 percent by weight before consolidation.

If desired, the abrasion and wear resistance of the paper layer can be increased by incorporating abrasive materials such as finely divided silica, silicon carbide, emery, diamond, tungsten carbide, titanium carbide, boron nitride, aluminum oxide and mixtures of such materials with each other and with other finely divided materials, the wear or abrasion resistance of the overlay being specifically tailored as described by using materials of the desired hardness. These materials can be uniformly distributed throughout the overlay as by the teaching of U.S. Pat. No. 3,373,070, to give uniform abrasion resistance as the overlay is worn away or they can be concentrated in the surface of the overlay or graded through the thickness of the overlay as desired.

In lieu of the thermosetting resin impregnated paper overlay, there can be used a thermosetting resin as such or compositions which take the place of the overlay. Typical of such thermosetting resin composition overlays are those described in U.S. Pat. Nos. 3,135,643 and 3,371,071 which are included by reference herein. According to these patents, a surface coating composition for decorative laminates is provided comprising a thermosetting resin of silica flour and a finely divided fibrous material in the form of discrete fibers. The silica flour and the finely divided fibrous material have a refractive index approximating that of the cured thermosetting impregnating resin where a transparent or highly translucent effect is desired. It will be realized, of course, that the silica flour can be substituted wholly or in appropriate amounts by the other hard materials, including those mentioned above, to obtain good abrasion resistance and transparency effect. This coating composition greatly improves the abrasion resistance of the laminates to which it is applied.

In preparing the laminate panel, the lane and approach portions of the laminate panel can readily be prepared with a low gloss or low luster finish. There are numerous methods for making low gloss melamine surfaced laminates. Some of these methods involve the use of release papers, plastic films and aluminum foil/paper composites between the laminate overlay and the press pan. However, the aforementioned methods yield a surface which is unacceptable for bowling. The finish provided by these methods also concurrently increases the coefficient of friction of the surface. The increased frictional characteristics of the "duller" surface provided by such methods would be unacceptable to the bowler. For example, a normally thrown hook delivery would hook so much that the ball would roll into the gutter before reaching the area of the lanes where the pins are set up. The reason for this is that in the case of release papers and foil paper composites, the fiber mat of the paper impresses a texture into the laminate that is too rough for bowling, even when fine lithograph paper is used with the foil. In the case of plastic film, the same thing occurs, but in reverse. The paper pattern of the laminate overlay sheet is pressed into the readily compressible film thus affording a self-texturing.

The present invention is based upon the discovery, disclosed in part in U.S. patent application Ser. No. 767,263, filed Feb. 10, 1977, and now abandoned, that aluminum foil, one side being matte finished, when pressed between the laminate and the press pan with the matte side against the laminate, will produce a gloss low enough to be aesthetically acceptable to the bowler, but with frictional characteristics comparable to present day wooden and plastic laminate surfaced lanes.

In preparing the laminate panel of the '604 application, the lane portion of the laminate panel can be readily prepared with gloss or finish to match the remainder of the lane in a well known manner as by simply pressing the lane portion of the laminate during fabrication against a stainless steel pan or other suitable surface which produces a surface to match the gloss of the lane proper which is usually higher than that of the approach area, be it wood or decorative laminate or other material. Likewise, the approach area of the laminate is pressed against a surface which will produce a finish or gloss to match the remainder of the approach or runway area.

According to the present invention, it has been found that where the gloss of the approach area is "duller" than the lane proper, aluminum foil of suitable matte finish can be used to produce the smaller degree of gloss. It will be realized, of course, that the entire approach on that area behind the lanes proper may be of the same construction, that is, of laminate. It will also be realized that in certain cases, the gloss of the approach area may be the same as that of the lane proper.

Aluminum foil, one side matte finished, when pressed between the laminate and the press pan with the matte side against the laminate, will produce a gloss low enough to be aesthetically acceptable to the bowler, but with frictional characteristics adequate for proper bowling. Foil thickness of 0.00035 and 0.010 inches may be acceptably employed. A foil thickness of 0.002 inches is preferred because of processability.

Pans or plates of aluminum, steel, chrome plated brass and the like could be made with a similar matte finish to provide the same full finish, but this has proven to be commercially impractical. In the process of handling the pans, they become scratched and marred and this is transferred to the laminate making it visually unacceptable. Continually retexturing pans to remove scratches is one means of which may be employed to overcome this problem according to applicant's invention. However, it is preferred from an enconomic viewpoint to use throwaway texturing media, i.e., the aluminum foils.

When aluminum foils having a thickness below 1 mil are employed, there is a distinct possibility of foil pitting occurring. The decorative laminate board would show evidence of pitting associated with blotches due to corrosion or oxidation of the aluminum. In fact, as little as one drop of water (approximately 0.05 grams) between the pan and the foil was found to produce a blotch of as large as a square foot with severe pitting in the blotch. This pitting problem has been avoided when aluminum foil having a thickness between about 0.0035 and 0.010 inches has been employed with extra pad stock sheets.

The following examples illustrate the practice of the present invention, it being realized that they are to be taken as exemplary only and not as limiting in any way.

EXAMPLE 1

This example illustrates a bowling lane having a decorative laminate surface incorporating a thermosetting resin impregnated paper overlay. There was prepared an overlay of alpha cellulose paper impregnated with a 50 percent water solution of melamine formaldehyde resin, specifically Cymel 428, the impregnated paper being dried to a resin content of 65 percent by weight. There was also prepared in a similar manner core layers of 130 pound basis weight kraft paper and 140 pound basis weight creped kraft paper which were impregnated with a 50 percent solution of standard alkaline catalyzed phenolformaldehyde resin, the dried resin content of each such core layer being about 30 percent by weight. The laminate was prepared by successively superimposing two phenolic impregnated kraft paper sheets, one phenolic resin impregnated kraft paper sheets, one 55-pound basis weight raw or unimpregnated print sheet and a melamine resin impregnated overlay paper as described above. The laminate so laid up was placed between polished stainless steel panels with the lane and approach area contacting aluminum foil (the matte side). The lay-ups were cured for 15 to 18 minutes at 130° to 135° C. at 1500 psi, the laminate then being cooled still under pressure to below 40° C. and removed from the press. Actually, the laminating process is of a time-temperature-pressure nature and can be prepared by curing for from about 20–25 minutes at from about 130° C. to 150° C. at pressures ranging from about 1000 psi to about 1500 psi. The resulting laminate was 130 mils thick and was sanded to a 125 mil thickness. As intimated above, the less melamine present in the print, the tougher the surface and the more impact and fracture resistant it is. Thus, in this example, a raw or unimpregnated print layer was used so that it could be impregnated but not excessively by reason of melamine resin migration from the melamine resin impregnated overlay paper. Print paper, conventionally treated with 30–50 percent by weight of melamine resin may also be used however. The finished laminate was cured to size and cemented using contact cement to an existing hardwood bowling lane. A typical installation, which can be varied as desired, is, with a twelve foot long panel, to have from three to five feet within the approach proper and the remainder in the lane area, thus removing seams from highly stressed areas because of ball impact, sliding of the players, and the like. Joints between laminate sheets were filled with elastomeric material, specifically RTV silicone calk. Other useful calks are well known polyurethane and polysulfide materials.

EXAMPLE 2

This example illustrates the practice of the present invention using in lieu of a resin impregnated paper overlay a thermosetting resin layer. The core sheets of this example were prepared as in Example 1. In lieu of the overlay sheet, an abrasion resistant, thermosetting resin composition was used prepared in accordance with Example 1 of U.S. Pat. No. 3,373,071 incorporated herein by reference. This thermosetting resin composition prepared by mixing in a high shear blender 64 parts of water, 12.5 parts of sodium carboxy methyl cellulose in 2 percent concentration and 10 parts of finely divided silica, there being added after mixing 100 parts of melamine resin, specifically Cymel 428, with further mixing to which resulting mixture there was added again with thorough mixing 10 parts of Avicel micro-crystalline cellulose. This resinous composition diluted to 50 percent solids in water, was used to impregnate a 55-pound basis weight print sheet to a dried resin composition content of 50 percent by weight. The various layers were then superimposed one upon the other and pressed under heat and with finish producing means as described in Example 1 to produce a laminate having an unsanded thickness of 130 mils which was reduced by sanding the back or core side to a final total thickness of 125 mils. The finished laminate was cut to size and cemented using contact cement to an existing hardwood bowling lane. Joints between laminate sheets were filled with elastomeric material, specifically the material of Example 1.

The following table shows the results of various tests performed on bowling lanes surfaced with the material of Examples 1 and 2 as compared with standard bowling lanes finished respectively with polyurethane varnish and nitrocellulose lacquer, all tests being carried out in accordance with NEMA publication LD 1-1964.

National Electrical Manufacturers Association Standard Tests (NEMA Pub. No. LD 1-64)

| Test | Example 1 | Example 2 | Polyurethane Varnish | Nitrocellulose Lacquer |
|---|---|---|---|---|
| Impact, falling ball | 60 inches | 60 inches | 32 inches | 30 inches |
| Impact, *16 pound bowling ball, 3 feet | No effect | No effect | Deep dent, torn wood fibers | Deep dent, torn wood fibers |
| Abrasion Resistance (Taber) | 500 cycles | 2500 cycles | 40 cycles | 25 cycles |
| Cigarette Resistance | 300 seconds | 300 seconds (charred) | 90 seconds (charred) | 24 seconds (on fire) |
| Hardness | | | | |
| Rockwell M | | 114 | Too soft to measure | |
| Barcol | | 65 | 0 | 0 |
| Coefficient of Friction | 0.18 | 0.18 | 0.18 | 0.16 |
| Staining | | | | |
| Alcohol | No | No | No | Yes |
| Detergent | No | No | No | No |
| Shoe polish | No | No | No | Yes |
| Mustard | No | No | Yes | Yes |
| Gloss, 60° | | | | |
| Length | | 75 | 74 | 62 |
| Cross | | 72 | 68 | 44 |

*Improvised test using bowling lane surface with the material of examples 1 and 2 or standard hardwood lane finished with either polyurethane varnish or nitrocellulose lacquer.

From the above it will be seen that the bowling lanes of the present invention surfaced with the present decorative laminate surfacing materials are far and away superior to present bowling lane or alley surfaces from the point of view of impact and abrasion resistance. At the same time, the present surfaces match or very closely approximate the coefficient of friction of present surfaces so that slippage and control of the ball on the mineral oil dressed lane is not changed. This is borne out by the experience of bowlers using the new lanes.

What I claim as new and desire to secure by Letters Patent of the United States is:

1. In a bowling lane having a surface characterized by a falling ball impact resistance of at least 60 inches, a coefficient of friction of at least 0.18 and a Taber abrasion resistance of at least about 500 cycles, said bowling lane comprised of a substrate selected from the group consisting of natural wood, consolidated wood fibers, plywood, flakeboard, chipboard and hardboard, and at least one decorative plastic laminate secured to the surface of said substrate, said plastic laminate sheet comprised of a plurality of thermosetting resin impregnated fibrous core sheets, a melamine resin impregnated decorative fibrous print sheets, and an overlying melamine resin containing protective layer, the improvement which comprises:

said surface further characterized by a 60 degree gloss below about 30 in the machine direction as measured according to NEMA Standard 8-19-1964.

2. A bowling lane as defined in claim 1 wherein said gloss is between about 10 and about 20.

3. A bowling lane as defined in claim 2 wherein said gloss is about 16.

4. A bowling lane as defined in claim 1 wherein said fibrous core sheets are impregnated with a phenolic resin.

5. A bowling lane as defined in claim 1 wherein said overlying protective layer is a fibrous sheet impregnated with melamine resin.

6. A bowling lane as defined in claim 1 wherein said overlying protective layer has abrasion resistant material incorporated therein.

7. A bowling lane as defined in claim 1 wherein the fibrous print sheet is paper.

8. In a decorative plastic laminate sheet of a length and width for securing to a substrate selected from the group consisting of natural wood, consolidated wood fibers, plywood, flakeboard, chipboard, and hardboard to form therewith all or part of a bowling lane having a surface characterized by a falling ball impart resistance of at least 60 inches, a coefficient of friction of about 0.18 and a Taber abrasion resistance of at least about 500 cycles, said plastic laminate sheet comprised of a plurality of thermosetting resin impregnated fibrous core sheets, a melamine resin impregnated decorative fibrous print sheets, and an overlying melamine resin containing protective layer, the improvement which comprises:

said surface of said decorative plastic laminate sheet having a 60 degree gloss below about 30 in the machine direction as measured according to NEMA Standard 8-19-1964.

9. A laminate sheet as defined in claim 8 wherein said gloss is between about 10 and 20.

10. A method of producing a bowling lane having a surface characterized by a falling ball impact resistance of at least 60 inches, a coefficient of friction of about 0.18 and a Taber abrasion resistance of at least about 500 cycles comprising:

superimposing a plurality of thermosetting resin impregnated fibrous core sheets on one another so that said ccore sheets are in registration;

superimposing a resin impregnated decorative fibrous print sheet over said thermosetting resin impregnated core sheets in parallel registration therewith;

superimposing an overlying resin containing protective layer over said resin impregnated decorative fibrous print sheet in registration therewith;

consolidating said thermosetting resin impregnated core sheets, said resin impregnated decorative fibrous print sheet and said overlying resin containing protective layer under heat and pressure, in a press pan or plate having a surface which is at least partially matte finished, to produce a unitary decorative plastic laminate sheet, said matte finish being scratch-free and capable of producing a surface on said laminate sheet having a 60 degree gloss below about 30 in the machine direction as measured according to NEMA Standard 8-19-1964; and bonding the laminate sheet to a substrate selected from the group consisting of natural wood, consolidated wood fibers, plywood, flakeboard, chipboard and hardboard.

11. A method as defined in claim 10 wherein all of the surface of said press pan or plate is matte finished.

12. A method as defined in claim 10 wherein said pan or plate is aluminum, steel or chrome.

13. A method as defined in claim 10 wherein said matte finish is provided by an aluminum foil lining said pan or plate and having said matte finished on one side thereof facing the laminate sheet surface.

14. A method as defined in claim 13 wherein said aluminum foil has a thickness between about 0.00035 inches and about 0.010 inches.

15. A method as defined in claim 14 wherein said thickness is about 0.002 inches.

* * * * *